US005601151A

United States Patent [19]

Warren

[11] Patent Number: 5,601,151

[45] Date of Patent: Feb. 11, 1997

[54] DRILLING TOOL

[75] Inventor: Tommy M. Warren, Coweta, Okla.

[73] Assignee: Amoco Corporation, Chicago, Ill.

[21] Appl. No.: 527,173

[22] Filed: Sep. 11, 1995

Related U.S. Application Data

[63] Continuation-in-part of Ser. No. 275,020, Jul. 13, 1994, abandoned.

[51] Int. Cl.[6] ..... E21B 7/08

[52] U.S. Cl. ..... 175/75; 175/61

[58] Field of Search ..... 175/73, 74, 75, 175/76, 61

[56] References Cited

U.S. PATENT DOCUMENTS

| | | | |
|---|---|---|---|
| 1,332,841 | 3/1920 | Jansen . | |
| 3,851,719 | 12/1974 | Thompson et al. | 175/406 |
| 4,231,437 | 11/1980 | Swersky et al. | 175/325 |
| 4,449,595 | 5/1984 | Holbert | 175/79 |
| 4,523,652 | 6/1985 | Schuh | 175/61 |
| 5,012,863 | 5/1991 | Springer | 166/55.3 |
| 5,213,168 | 5/1993 | Warren et al. | 175/75 X |

*Primary Examiner*—William P. Neuder
*Attorney, Agent, or Firm*—James A. Gabala; Robert E. Sloat

[57] ABSTRACT

A hole opener comprising: a cylindrical section of pipe; a nose; a plurality of cutting elements that extend radially from the pipe and that produce a lateral force on the hole opener in response to the rotation of the hole opener in the borehole; lower reaction pad means, extending radially from the pipe section to trail behind the cutting elements and located generally below the cutting elements, for continuously contacting the borehole wall during rotation of the hole opener and for receiving reactive forces that are in response to the lateral force; and upper reaction pad means, extending radially from the pipe section to trail behind the cutting elements and located generally above the cutting elements, for continuously contacting the borehole wall during rotation of the hole opener and for receiving reactive forces that are in response to the lateral force.

20 Claims, 2 Drawing Sheets

DRILLING TOOL

RELATED PATENT APPLICATION

This is a continuation-in-part of a U.S. patent application filed on Jul. 13, 1994 and having a Ser. No. of 275,020 and abandoned following the filing of this patent application.

TECHNICAL FIELD

This invention relates to the general subject of oil well and gas drilling and, in particular to apparatus and methods used to drill a curved wellbore in the surface of the earth.

BACKGROUND OF THE INVENTION

There are many enhanced recovery methods used to maximize the total oil recovered from fields. Unfortunately, even after the latest techniques are used, vast oil resources are left unproduced.

Lateral wellbores offer the potential to drain more oil than would be recovered otherwise. Laterals can be used to tap fresh oil by intersecting fractures, penetrating pay discontinuities, and draining up-dip traps. Lateral re-completions can also be used to correct production problems, such as water coning, gas coning, and excessive water cuts from hydraulic fractures which extend below the oil-water interface. Synergistic benefits may result from coupling lateral re-completions with enhanced recovery techniques to solve conformance problems, to contact un-swept oil by re-completing injection wells, and to re-direct sweep by converting existing well patterns into line-drive configurations. Lateral re-completions strategies can take advantage of the current production infrastructure, capital resource of existing wellbores, known resources of oil in place, and secondary and tertiary recovery technology.

When drilling laterals the rate of inclination change is usually described by the radius of curvature of the borehole. This is different from conventional drilling where curved boreholes are often described by the build or drop rate in degrees per 100 feet. A "short radius" curve is generally considered to have a radius of curvature of less than 150 feet. A "medium radius" is about 150 to 300 feet and a "long radius" curve is anything beyond 300 feet. For comparison, a 5 degree per 100 feet build is approximately equal to a 1,000 foot radius curve. None of the various curve rates (short, medium, long) are inherently better than the others. Depending on the objectives for a given well and the constraints of the situation, one curve rate will often be more suitable than another. However, as a general rule, short radius curves are often more desirable in re-completions where there is minimal open hole between the casing seat and the target zone. The shorter the radius, the less likely a section will need to be removed from the casing. Short radius curves also allow submersible pumps to be located close to pay zones. And the shorter the curve, the less formation above the target zone will need to be penetrated. This may reduce the problems associated with having open hole exposed to unstable shales, gas caps, and other producing zones. As the radius of curve gets smaller, so does the length of the lateral which can be drilled. Small radius curves also restrict the types of completions which can be performed. For example, it would not be realistic to case a 30 foot radius curve conventionally.

When drilling a curved borehole having a short radius of curvature, a flexible or an articulating drill pipe section is added to the curve drilling assembly (e.g., see U.S. Pat. Nos. 5,210,533 and 5,194,859 assigned to Amoco Corporation). The articulating section typically comprises short sections of pipe having articulating joints, or the like, as would be known to one skilled in the art. The articulating section is provided so the drill string does not impair the ability of the curve drilling assembly to drill a short radius curved borehole (i.e., a conventional drill string often does not have enough flexibility to traverse the short radius curved borehole and therefore may not allow the assembly to drill a short radius curved borehole and, if it is placed in a short radius curve, it may fatigue and fail after only a few rotations). The articulating section preferably extends uphole from the curve drilling assembly through the curved portion of the borehole.

Articulated drill collars are commonly called "wiggly pipe". They are constructed by cutting a series of interlocking lobed patterns through the wall of steel drill collars (e.g., see U.S. Pat. Nos. 4,483,721 and 4,476,945). Each such collar is fitted with a high pressure hydraulic hose and seal assembly. Historically, these collars have been the only reasonable option for rotating through a short radius curve, but they are not ideal because they attempt to straighten under compressive loading, cause the drillstring to rotate rough, complicate the procedure for orienting the deflection sleeve and are difficult to handle.

A major impediment to the widespread use of lateral re-entries is that drilling and completion of the laterals must be done economically. Workover economics in mature fields requires substantial cost reductions over the methods most often used for drilling new horizontal wells. Thus, there is a continuing need for reliable reduced-cost lateral drilling systems and tools, particularly tools that are easy to use with commonly used components and parts of curved drilling systems.

One situation that often occurs is the need to enlarge or widen a curved section of a well bore after the curve drilling is completed. For example, it is sometimes helpful to open a 3¾" or a 3 15/16" curve to 4¾". The larger opening facilitates running the lateral drilling assembly and reduces the torque required to rotate wiggly pipe in the curved section while lateral drilling. Opening the hole also makes the wiggly pipe more "fishable" in case it becomes lost in the hole. If a 4¾" drill bit or a conventional 4¾" PDC reaming tool (e.g., see U.S. Pat. Nos. 1,332,841; 4,431,065; and 3,851,719) was used to do this, drilling torque would be very erratic and the penetration rate would be slow. Moreover, existing reaming tools have not been proven to be very durable. Clearly, improvement is needed.

SUMMARY OF THE INVENTION

A general object of the invention is to provide a tool for opening or enlarging the borehole formed by a short radius curved drilling assembly.

Another object of the invention is to provide a hole opener for a shot-radius drilling assembly.

One particular object of the invention is to provide a low friction hole opener.

Still another object of the invention is to provide an apparatus that makes wiggly pipe sections easier to fish, if they were to fail in a short radius curved borehole.

Yet another object of the invention is to provide a more durable hole opener.

In accordance with the present invention, disclosure is made of a hole opener for use with a flexible drill string. The hole opener comprises: a base disposed about a longitudinal bit axis for connecting to the downhole end of the flexible drill string; a gauge portion that is disposed about the longitudinal bit axis, that extends from the base, that has an uphole end and that has a downhole end; a nose disposed about the longitudinal bit axis and extending from the gauge portion; a plurality of cutting elements that are carried by and extend from the gauge portion and that produce a lateral force on the hole opener at its downhole end in response to the rotation of the hole opener in the borehole; lower reaction pad means, carried by and extending from the gauge portion to trail behind the cutting elements by a maximum of 180 degrees and located generally below the cutting elements, for continuously contacting the borehole wall during rotation of the hole opener and for receiving a reactive force that is from the borehole, that is in response to the lateral force and that is directed adjacent to the downhole end of the hole opener, the lower reaction pad means extending from the longitudinal bit axis by no more than the bore in which the hole opener is inserted; and upper reaction pad means, carried by and extending from the gauge portion to trail behind the cutting elements by a maximum of 180 degrees and located generally above the cutting elements, for continuously contacting the borehole wall during rotation of the hole opener and for receiving a reactive force that is from the borehole, that is in response to the lateral force and that is directed adjacent to the uphole end of the hole opener, the upper reaction pad means extending from the longitudinal bit axis by approximately the same amount as the cutting elements, the lower reaction pad means and the upper reaction pad means having the effect of directing the longitudinal axis of the base portion to be tangent to the centerline of the curved portion of the borehole in which it is inserted.

The new tool operated much better than any other tool used for opening a curved borehole. It has been used successfully in several wells and has resulted in no problems to date. Numerous other advantages and features of the present invention will become readily apparent from the following detailed description of the invention, the embodiments described therein, from the claims, and from the accompanying drawings.

DETAILED DESCRIPTION

Figure 1:
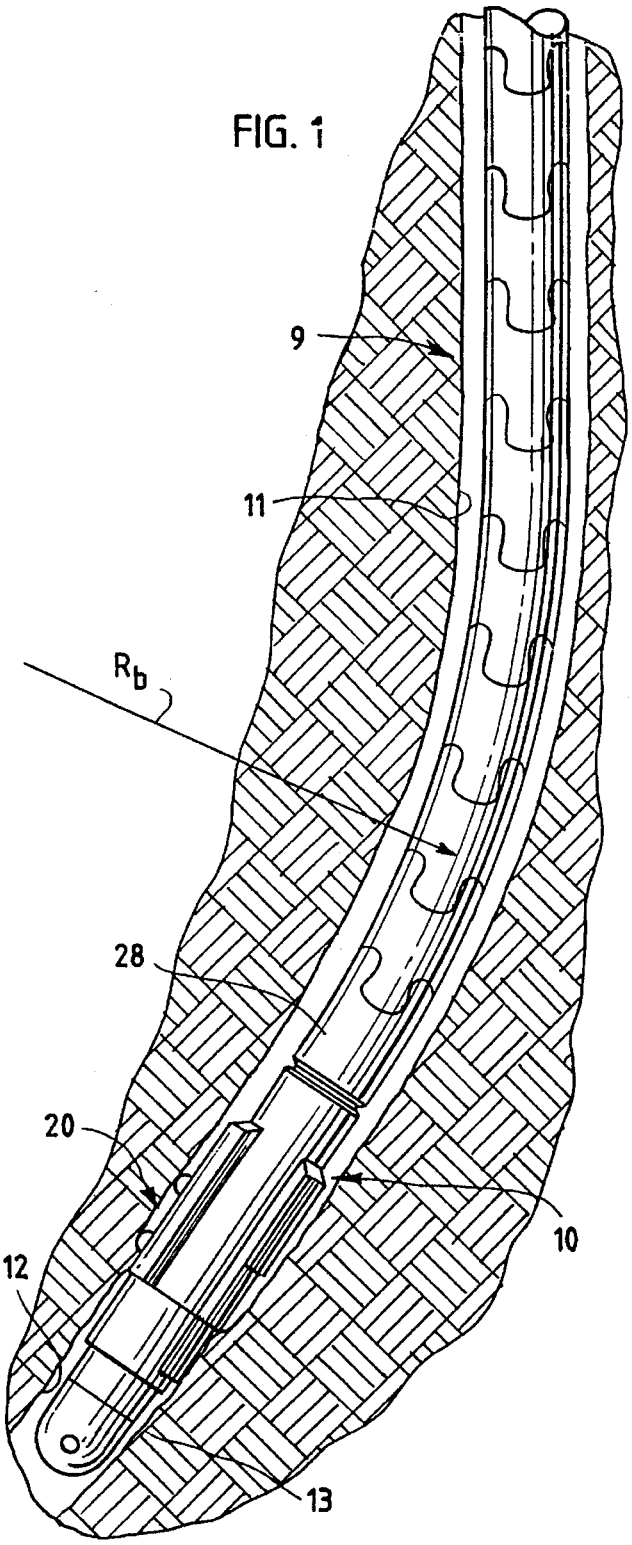
FIG. 1 is a schematic diagram of the downhole end of a drill string having the hole opener that is the subject of the present invention.

While this invention is susceptible of embodiment in many different forms, there is shown in the drawings, and will herein be described in detail, one specific embodiment of the invention. It should be understood, however, that the present disclosure is to be considered an exemplification of the principles of the invention and is not intended to limit the invention to the specific embodiment illustrated.

Turning to FIG. 1, the downhole end of a short radius curved drill string 9 is shown in a curved borehole 12 of an oil or gas well. The borehole 12 is characterized by a radius of curvature $R_b$. The drill string 9 is operated by a conventional rotational drive source (not shown in the drawings for purposes of simplicity and known to those skilled in the art) for drilling in subterranean earthen materials to create a borehole 12 having a borehole wall 11. The drilling tool 10 or "hole opener," that is the subject of the invention, is located at the end of the drill string 9. In particular, the hole opener 10 comprises a base 14, a gauge portion 16, a drilling pilot or "bullnose" 18, a plurality of cutting elements 20, a lower reaction pad 22; and an upper reaction pad 24. The hole opener 10 is used to enlarge the diameter of the borehole 12. The interior of the tool 10 has a central bore 15 for ducting drilling fluid through openings 17 in the nose 18.

The base 14 is located at the up-hole end of the tool 10 and is disposed about a longitudinal axis 26 The base provides a means for connecting the tool 10 to the downhole end of a section of wiggly pipe 28. The gauge portion 16 is generally cylindrical in shape and also disposed about the longitudinal axis 26. The gauge portion 16 extends downwardly from the base 14. The gauge portion 16 has an uphole end and an opposite downhole end. The bullnose 18 is also disposed about the longitudinal axis 26 and extends downwardly from the gauge portion 16. The bullnose 18 has a length that is sufficiently short, relative to the length of the gauge portion 16 and the base 14, that the end of the nose does not contact the outside wall 13 (see FIG. 1) of the curved borehole 12.

The cutting elements 20 extend from the gauge portion 16. The cutting elements 20 produce a lateral force on the hole opener 10 in response to the rotation of the hole opener in the borehole 12. Preferably, the cutting elements 20 are close enough to the first flexible interlocking lobe of wiggly pipe 28 that the lobe does not engage the curved borehole wall 11 and cause the tool 10 to be inclined with respect to the borehole centerline (at radius $R_c$) at the blade. In other words, if the gauge portion 16 is located at a distance $R_g$ from the longitudinal axis 26, the cutting elements 20 are located at a distance $R_c$ from the longitudinal axis, and the borehole has a radius of curvature $R_b$, the cutting elements are preferably located at a distance L from the downhole end of the flexible section of drill pipe 28 that is connected to the hole opener 10, where L has a magnitude on the order of the square root of the product of $R_b$ and $(R_c-R_g)$.

Figure 4:
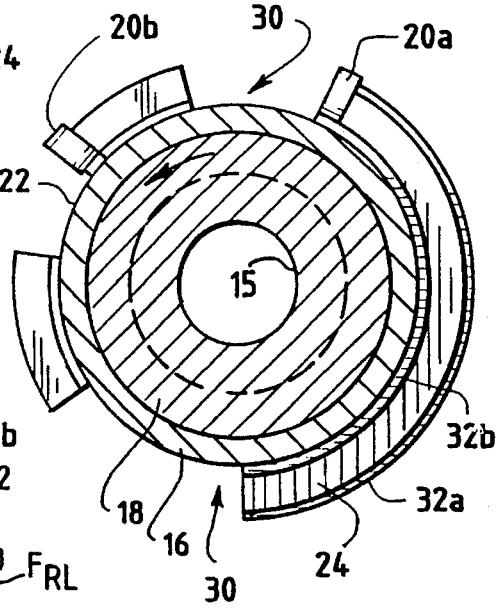
FIG. 4 is a cross-sectional view of the hole opener of FIG. 3, as viewed along line 4—4.

The lower reaction pad 22 is carried by and extends from the gauge portion 16. It is positioned to "trail" (i.e., relative to the normal direction of rotation of the drill pipe 28) behind the cutting elements 20 by a minimum of 90 degrees and a maximum of 180 degrees (See FIG. 4). The lower reaction pad 22 is located generally below the axial position of the cutting elements 20 and substantially continuously contacts the borehole wall 12 during rotation of the hole opener 10. The lower reaction pad 22 receives a reactive force $F_{RL}$ that is from the borehole wall 12, that is in response to the lateral force from the cutting elements 20, and that is directed adjacent to the downhole end of the gauge portion 16 of the hole opener 10. The lower reaction pad 22 extends from the longitudinal axis 26 by no more than the bore (i.e., $2R_g$ in which the hole opener 10 is inserted).

The upper reaction pad 24 is carried by and extends from the gauge portion 16. It is positioned generally above the cutting elements 20 and to "trail" behind the cutting elements by a minimum of 90 degrees and a maximum of 180 degrees. The upper reaction pad 24 substantially continuously contacts the borehole wall 12 during rotation of the hole opener 10. The upper reaction pad 24 receives a reactive force $F_{RU}$ that is from the borehole 12, that is in response to the lateral force from the cutting elements 20, and that is directed next to the uphole end of the gauge portion 16 of the hole opener 10. The upper reaction pad 24 extends from the longitudinal axis by about the same amount $R_c$ as the cutting elements 20 (see FIG. 3).

The lower reaction pad 22 and the upper reaction pad 24 have the effect of positioning the longitudinal axis 26 of the hole opener 26 to be tangent (see FIG. 1) to the centerline of the curved portion $R_b$ of the borehole 12 in which it is inserted. Preferably, the upper reaction pad 24 and the lower reaction pad 22 are located about 120 degrees behind the cutting elements 20 with the upper reaction pad directly above the lower reaction pad. The exact radial position of the pads is determined by considering the magnitude and direction of the two reactive forces $F_{RL}$ and $F_{RU}$. Radial separations as much as 90 degrees may be possible. The upper reaction pad 24 and the lower reaction pad 22 are not continuous when viewed from either end of the tool (see FIG. 4). Each pad is broken by a series of longitudinal grooves or channels 30 formed on the exterior surface of the tool. These channels 30 allow drilling fluid released from the nose part 17 to return upwardly to the well head while lubricating the cutters 20 and flushing earthen materials removed by the cutters.

Figure 2:
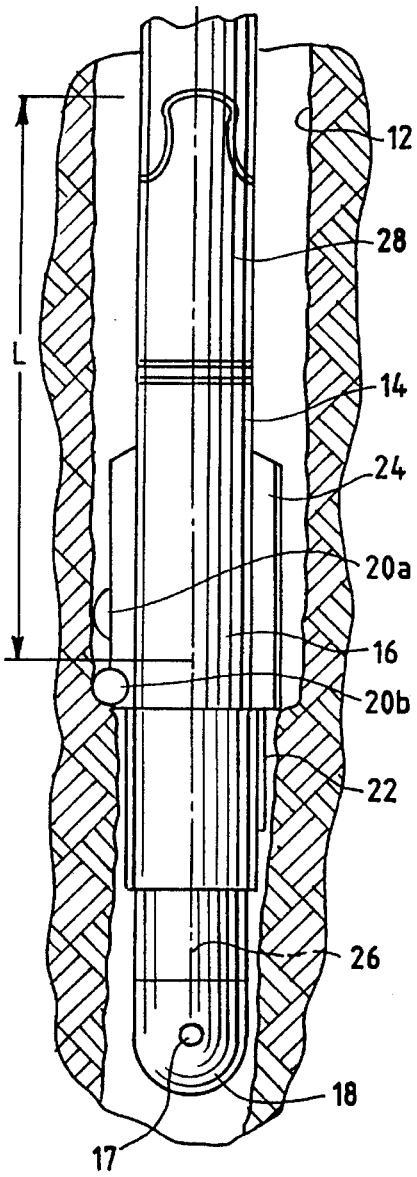
FIG. 2 is an enlarged view of the lower end of the bore and the tool of FIG. 1.

Each of the cutting elements 20 preferably comprises a poly-crystalline diamond (PCD) compact material mounted on a support, such as a carbide or steel support. The cutting elements 20 may, of course, include other materials such as natural diamond and thermally stable polycrystalline diamond material. Each of the cutting elements 20 has a base disposed in the gauge portion 16 and a cutting edge for contacting the subterranean earthen materials of the bore. The cutting elements 20 are oriented with a flat side in the penetrating direction so they cut a flat ledge, rather than a tapered ledge. This orientation was selected because it is believed that, with a tapered edge, the tool 10 might take too big a bite which would cause the tool to run rough. As shown in FIG. 2, there are two distinct cutting elements or cutters 20*a* and 20*b*. One cutter 20*a* is located closer to the uphole and of the tool 10. As such, the lower cutter 20*b* engages the walls 11 of the borehole in advance of the upper cutter 20*a*. More than two distinct cutters may be employed. Only two cutters 20*a* and 20*b* are shown for simplicity.

The cutting elements 20 create a net imbalance force $F_i$ along a net imbalance force vector that is substantially perpendicular to the longitudinal bit axis 26 when the tool 10 is rotated. Before proceeding, it is appropriate to state the preferred features and properties of the imbalance force $F_i$, the various forces acting on the tool 10 during rotation, and how these forces are managed.

The imbalance force $F_i$ may be provided by a mass imbalance in the tool 10. Preferably, the imbalance force is produced by the cutting elements 20. When produced by the cutting elements 20, the magnitude and direction (See FIG. 3) of net imbalance force vector $F_i$ will depend on the position and orientation of the cutting elements (e.g., the specific arrangement of cutting elements 20*a* and 20*b* on the tool 10 and the shape of the gauge portion 16 on which they are located. Orientation includes the backrake and the siderake of the cutting elements. The magnitude and direction of the net force vector $F_i$ is also influenced by the specific design (e.g., shape, size, etc.) of the individual cutting elements 20*a* and 20*b*, the load applied to the tool 10, the speed of rotation, and the physical properties of the subterranean earthen material being drilled. By "load" is meant the longitudinal or axial force applied by the rotational drive source downhole on the drill string 9.

In any case, the cutting elements 20 are located and positioned to cause net imbalance force vector $F_i$ to maintain substantially the reaction pads 20 and 24 in contact with the borehole wall when the tool is used. Preferably, the cutting elements 20 are located and positioned to cause net imbalance force vector $F_i$ to have an equilibrium direction, and to cause net radial imbalance force vector to return substantially to the equilibrium direction in response to a disturbing displacement. These aspects of the invention and the related forces on the drill bit are discussed in U.S. Pat. Nos. 5,213,168; 5,131,478; 5,042,596 and 5,111,892—all assigned to Amoco Corporation. The position and arrangement of the cutting elements 20 shown in the drawings is by way of illustration, however, and not by way of limitation. For example, cutting elements 20 may be positioned in a non-linear pattern, a curved pattern, or they may be positioned in a non-uniform, random pattern on the blade. All of the cutting elements 20 serve to produce a net imbalance force vector $F_i$ that is located substantially perpendicular to the longitudinal bit axis 26 when the tool is used.

Figure 3:
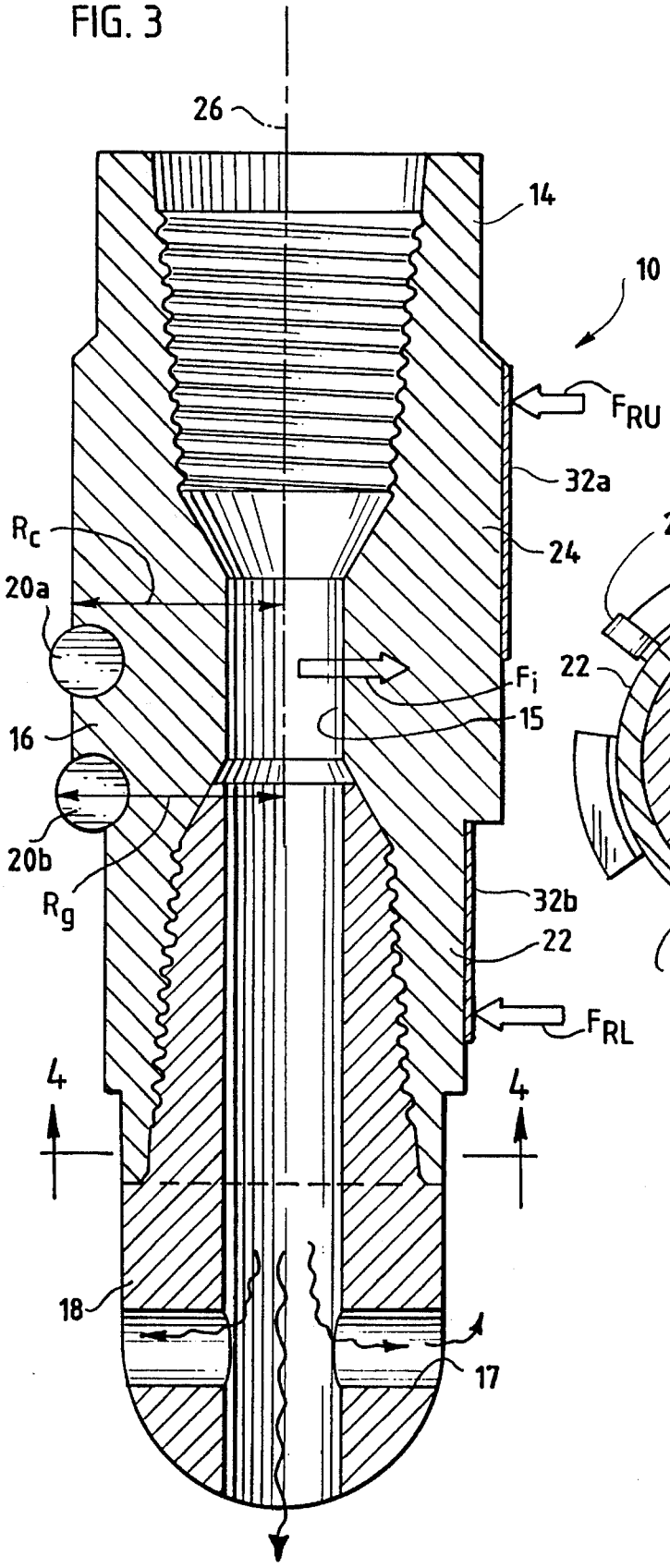
FIG. 3 is a elevation view of the hole opener of FIG. 1.

The reaction pads 22 and 24 have preferably sliding, borehole engaging surfaces 32*a* and 32*b* for intersecting a force plane that is defined by the net imbalance force vector $F_i$ and the longitudinal axis 26. Preferably, these bearing or sliding surfaces 32*a* and 32*b* form substantially continuous regions that are devoid of cutting elements and borehole abrasive surfaces. The cutting element devoid regions intersect a force plane defined by the longitudinal tool axis 26 and net imbalance force vector $F_i$. This force plane is conceptual and is useful for reference purposes and in explaining the effect of the net imbalance force vector $F_i$ on the tool 10. When the drilling tool 10 is viewed longitudinally as shown in FIG. 3, this force plane emerges in the plane of the drawing sheet.

Preferably, the bearing surfaces 32*a* and 32*b* substantially and continuously contact the borehole wall 12 when the tool 10 is used. Preferably, the bearing surfaces 32*a* and 32*b* are substantially smooth and wear-resistant (e.g. a 1/16 inch hard-coat for 2Rg=4⅝ inches) and slidably contact the borehole wall when the tool 10 is used. In particular, the lower reaction pad 32*b* preferably should not have cutters on its lower end. If cutters are placed there, the tool 10 will have a tendency tilt in the borehole which will cause poor performance and excessive tool wear. Non-cutting pad/surfaces 32*a* and 32*b* should be located above and below the cutters 20 to make the tool 10 stay centered in the hole.

The specific size and configuration of bearing surfaces 32*a* and 32*b* will depend on the specific tool 10 design and application. Preferably, the bearing means or sliding surfaces 32*a* and 32*b* extend along substantially the entire length of the gauge portion of the tool 10. Preferably, the sliding surfaces 32*a* and 32*b* are sufficiently large in surface area so, as the sliding surfaces are forced against the borehole wall, the applied forces will be much less than the compressive strength of the subterranean earthen materials of the borehole wall. This keeps the sliding surfaces 32*a* and 32*b* from digging into and crushing the borehole wall, which could result in the creation of an undesired whirling motion and over-gauging of the borehole 26. Preferably, the sliding surfaces 32*a* and 32*b* have a size sufficiently large to encompass net imbalance force vector $F_i$ as that vector moves in response to changes in hardness of the subterranean earthen materials and to other disturbing forces within the borehole. Preferably, the size of the sliding surfaces 32*a* and 32*b* is also selected so that the net imbalance force vector $F_i$ remains encompassed by the sliding surface as the cutting elements 20 wear.

The operation of the tool 10 will now be described. Once a short radius curve 12 is drilled and the curve drilling tool is withdrawn from the wellbore, the hole opening tool 10 is attached to a sufficient length of wiggly collars to traverse the curved borehole. The hole opening tool 10 is then tripped into the wellbore and positioned at the top (i.e., beginning) of the curve. Next, the mud pumps are engaged and drilling fluid is circulated through the drillstring and the tool 10. Rotation of the assembly is initiated and the drillstring is slowly advanced. The advancement rate is controlled so the force applied to the hole opening tool 10 is not excessive. As the tool 10 advances through the curve, it enlarges it from diameter of 2R a diameter of 2Rc.

From the foregoing description, it will be observed that numerous variations, alternatives and modifications will be apparent to those skilled in the art. Accordingly, this description is to be construed as illustrative only and is for the purpose of teaching those skilled in the art the manner of carrying out the invention. Various changes may be made, materials substituted and features of the invention may be utilized. For example, the bearing surfaces 32*a* and 32*b* may comprise one or more rollers, ball bearings, or other low friction load bearing surfaces. The sliding or bearing surfaces 32*a* and 32*b* may comprise the same material as other portions of tool 10, or a relatively harder material such as a carbide material. In addition, the bearing surfaces 32*a* and 32*b* may include wear-resistant coatings or diamond impregnation, a plurality of diamond stud inserts, a plurality of thin diamond pads, or similar inserts or impregnation that strengthen the bearing surfaces and improve their durability. The elevation of the upper reaction pad 24 may also be selected to act as a penetration rate limiter to help keep the operating torque smoother. Similarly, a penetration rate limiter can be installed on the up-hole side of the tool to limit the depth of cut of the cutters 20 (for example, a penetration rate of 20 ft/hr at 60 RPM). Moreover, a sizing cutter can be added down-hole of the cutters 20 to insure the tool would work even if the original bore were slightly undersize (i.e., a 3 15/16 inch cutter for a 3 15/16 inch bore being enlarged to 4¾ inches). This sizing cutter may lead to degraded performance since it can cut out the low side of the curved borehole and cause the tool to tilt. Thus, it will be appreciated that various modifications, alternatives, variations, etc., may be made without departing from the spirit and scope of the invention as defined in the appended claims. It is, of course, intended to cover by the appended claims all such modifications involved within the scope of the claims.

I claim:

1. In a curve drilling assembly that is connectable to a rotary drill string for drilling a curved subterranean borehole having a bottom, having walls, having an inside radius and having an outside radius, the assembly comprising a flexible drill pipe section, a hole opener for enlarging the curved borehole comprising:

a base disposed about a longitudinal bit axis for connecting to the downhole end of the flexible drill pipe section;

a gauge portion that is disposed about said longitudinal bit axis, that extends from said base, that has an uphole end and that has a downhole end;

a nose disposed about said longitudinal bit axis and extending from said gauge portion;

a plurality of cutting elements that are carried by and extend from said gauge portion and that produce a lateral force on said hole opener at the downhole end of said hole opener in response to the rotation of the hole opener in the borehole;

lower reaction pad means, carried by and extending from said gauge portion to trail said cutting elements by a maximum of 180 degrees and located generally below said plurality of cutting elements, for continuously contacting the borehole wall during rotation of the hole opener and for receiving a reactive force that is from said borehole, that is in response to said lateral force and that is directed adjacent to said downhole end of said gauge portion, said lower reaction pad means extending from said longitudinal bit axis by no more than the bore in which said hole opener is inserted; and upper reaction pad means, carried by and extending from said gauge portion to trail said cutting elements by a maximum of 180 degrees and located generally above said plurality of cutting elements, for continuously contacting the borehole wall during rotation of the hole opener and for receiving a reactive force that is from said borehole, that is in response to said lateral force and that is directed adjacent to said uphole end of said gauge portion of said hole opener, said upper reaction pad means extending from said longitudinal bit axis by approximately the same amount as said cutting elements, said lower reaction pad means and said upper reaction pad means having the effect of directing said longitudinal axis of said base portion to be tangent to the centerline of the curved portion of the borehole in which it is inserted.

2. The hole opener of claim 1, wherein said nose is sufficiently short relative to the length of said gauge portion and said base that said nose does not contact the outside of the curved borehole.

3. The hole opener of claim 1, wherein said cutting elements are sufficiently close to the downhole end of the flexible pipe section relative to the radius of curvature of said borehole that said downhole end of the flexible pipe section does not engage the curved borehole and cause said cutting elements to become inclined relative to the centerline of the curved borehole.

4. The hole opener of claim 3, wherein said gauge portion is located at a first distance Rg from said longitudinal axis, said cutting elements are located at a second distance Rc from said longitudinal axis, said borehole has a radius of curvature Rb at said cutting elements, and said cutting elements are located at a third distance L from the downhole end of the flexible drill pipe section, where said third distance L is a function of the product of said radius of curvature Rb and the difference (Rc–Rg) of said first distance and said second distance.

5. The hole opener of claim 4, wherein third distance L is on the order of the square root of said product.

6. The hole opener of claim 1, wherein said upper reaction pad means is positioned to trail behind said cutting elements by at least 90 degrees.

7. The hole opener of claim 1, wherein said lower reaction pad means is positioned to trail behind said cutting elements by at least 90 degrees.

8. The hole opener of claim 1, wherein said flexible section of drill pipe comprises wiggly pipe.

9. The hole opener of claim 1, wherein said flexible section of drill pipe comprises a plurality of articulated drill pipe segments.

10. The hole opener of claim 1, wherein said nose has an uphole end that is carried by said downhole end of said gauge portion and has a downhole end which is generally hemispheric in shape.

11. The hole opener of claim 1, wherein said gauge portion comprises a generally cylindrical section of pipe having a hollow interior and a plurality of longitudinally extending channels on its exterior surface.

12. In a curved subterranean borehole having an inside radius, having an outside radius, and having a predetermined borehole radius, a curve-opening tool comprising:

a body that is disposed about a longitudinal bit axis, that has an uphole for connecting to the downhole end of a flexible pipe section, and that has a downhole end;

a generally smooth nose extending from said downhole end of said body, said nose having a length that is sufficiently short relative to the length of said body that said nose does not substantially contact the outside of the curved borehole;

cutting elements that are carried by and extend from said body intermediate said ends of said body, that cut along a line generally parallel to said longitudinal axis and that produce a lateral force on said body in response to rotation in the borehole;

a lower reaction pad that is carried by and extends from said body to trail said cutting elements by a minimum of 90 degrees and a maximum of 180 degrees and that extends toward said downhole end of said body so as to contact the borehole wall during rotation in the borehole and receive a reactive force that is from said borehole, that is in response to said lateral force and that is directed adjacent to said downhole end of said body, said lower reaction pad extending from said longitudinal axis by no more than the radius of the wellbore in which said tool is inserted; and an upper reaction pad that is carried by and extends from said body to trail said cutting elements by a minimum of 90 degrees and a maximum of 180 degrees, that extends toward said uphole end of said body to contact the borehole wall during rotation in the borehole and receive a reactive force that is from said borehole, that is in response to said lateral force and that is directed adjacent to said uphole end of said body, said upper reaction pad extending from said longitudinal axis by about the same amount as said cutting elements, said lower reaction pad and said upper reaction pad having the effect of positioning said body such that said longitudinal axis is generally tangent to the centerline of the curved portion of the borehole in which it is inserted.

13. The curve-opening tool of claim 12, wherein said body has an exterior surface that is located at a distance Rg from said longitudinal axis; wherein said cutting elements have an edge that is located at a distance Rc from said longitudinal axis; wherein said borehole has a radius of curvature Rb where said edge is located; and wherein said cutting elements are located at a distance L from the downhole end of said flexible section of drill pipe, where L has a magnitude on the order of the square root of the product of Rb and (Rc–Rg).

14. The curve-opening tool of claim 12, wherein said body comprises a section of pipe having at least two elongated drilling fluid channels on its exterior.

15. The curve-opening tool of claim 14, wherein said lower reaction pad and said upper reaction pad have portions extending between said channels.

16. A hole opener for enlarging a short radius curved subterranean borehole, having walls, having an inside radius and having an outside radius, comprising:

a cylindrical section that has one end for connecting to the downhole end of a flexible section of drill pipe, said cylindrical section having a length that is sufficiently short that its opposite end does not engagingly contact the outside of the curved borehole;

cutters that are carried intermediate ends of said section, that extend from said section, that have cutting edges generally aligned to the axis of said section and that produce a lateral force on said section in response to the rotation of the hole opener in the borehole;

lower reaction pad means, carried by and extending radially from said section to trail said cutters by a minimum of 90 degrees and a maximum of 180 degrees and located generally towards said opposite end of said section, for engaging the borehole wall during rotation of the hole opener and for receiving a reactive force that is from said borehole, that is in response to said lateral force and that is directed towards said opposite end of said section, said lower reaction pad means extending from said axis by no more than the radius of the wellbore in which said hole opener is inserted; and upper reaction pad means, carried by and extending from said section to trail said cutters by a minimum of 90 degrees and a maximum of 180 degrees and located generally toward said one end of said section, for engaging the borehole wall during rotation of the hole opener and for receiving a reactive force that is from said borehole, that is in response to said lateral force and that is directed towards said one end of said section, said upper reaction pad means extending from said axis by approximately the same amount as said cutters, said lower reaction pad means and said upper reaction pad means having the effect of aligning the longitudinal axis of said cylindrical section to be tangent to the centerline of the curved portion of the borehole in which said hole opener is inserted.

17. A tool for enlarging a short radius curved subterranean borehole having a predetermined diameter, comprising:

a base that has a longitudinal axis that has an uphole end for connecting to the downhole end of an articulated section of drill pipe, and that has a downhole end;

a nose located at said downhole end of said base, said nose having a length that is sufficiently short relative to the length of said base and having a generally smooth exterior such that said nose does not engagingly contact the curved borehole;

a plurality of cutting elements that are carried by and extend radially and longitudinally from said base and that produce lateral forces on said base in response to the rotation of the base in the borehole;

reaction pad means, carried by and extending from said base to trail behind said cutting elements, for continuously contacting the borehole wall during rotation of the base and for receiving a reactive force that is from said borehole and that is in response to said lateral force, said reaction pad means comprising one radial member that extends towards said uphole end and from said longitudinal axis by an amount that is about the same as said cutting elements, and comprising another radial member that extends toward said nose and from said longitudinal axis by no more than the bore in which said tool is inserted, said radial members having the effect of aligning said axis of said base to be tangent to the centerline of the curved portion of the borehole.

18. The tool of claim 17, wherein said one radial member is positioned to trail behind said cutting elements by a minimum of 90 degrees and a maximum of 180 degrees; and wherein said another radial member is positioned to trail behind said cutting elements by a minimum of 90 degrees and a maximum of 180 degrees.

19. The tool of claim 17, wherein said reactive force is from said borehole and comprises components that are directed to locations adjacent to each of said radial members.

20. In a curve drilling assembly that is connectable to a rotary drill string for drilling a curved subterranean borehole having walls, having an inside radius and having an outside radius, a tool for enlarging the curved borehole, comprising:

a base that disposed about a longitudinal axis for connecting to the downhole end of the drill string, said base having an uphole end that is connectable to the downhole end of a section of wiggly pipe and having a downhole end that is located at a predetermined distance from said uphole end of said base such that said downhole end of said base does not engagingly contact the walls of the wellbore;

cutting elements that are located intermediate said ends of said base, that are carried by and extend radially and longitudinally from said base, and that produce a lateral force on said base in response to rotation of said cutting elements against the walls of the borehole;

a lower reaction pad that is carried by said base, that is located generally towards said downhole end of said base, and that extends from said longitudinal axis by no more than the bore in which the tool is inserted; and an upper reaction pad that is carried by said base, that is located generally towards said uphole end of said base and that extends from said longitudinal axis by about the same amount as said cutting elements, said lower reaction pad and said upper reaction pad trailing behind said cutting elements and contacting the borehole wall during rotation of the base to receive a reactive force that is in response to said lateral force and to maintain said longitudinal axis generally tangent to the centerline of the curved portion of the wellbore.

* * * * *

UNITED STATES PATENT AND TRADEMARK OFFICE

CERTIFICATE OF CORRECTION

PATENT NO. : 5,601,151

DATED : February 11, 1997

INVENTOR(S) : Tommy M. Warren

It is certified that error appears in the above-indentified patent and that said Letters Patent is hereby corrected as shown below:

| Col. | Line | |
|---|---|---|
| 5 | 2-3 | "The upper reaction pad 24 extends from the longitudinal axis" should read --The upper reaction pad 24 extends from the longitudinal axis 26-- |
| 7 | 11 | "2R" should read --2Rg-- |

Signed and Sealed this

Sixth Day of May, 1997

Bruce Lehman

BRUCE LEHMAN

*Commissioner of Patents and Trademarks*

*Attest:*

*Attesting Officer*